US009766581B2

(12) United States Patent
Sato

(10) Patent No.: US 9,766,581 B2
(45) Date of Patent: Sep. 19, 2017

(54) PAPER FEED DEVICE AND IMAGE FORMING APPARATUS

(71) Applicant: Konica Minolta, Inc., Chiyoda-ku, Tokyo (JP)

(72) Inventor: Ryuji Sato, Toyohasi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/274,239

(22) Filed: Sep. 23, 2016

(65) Prior Publication Data

US 2017/0090385 A1 Mar. 30, 2017

(30) Foreign Application Priority Data

Sep. 29, 2015 (JP) ..... 2015-190704

(51) Int. Cl.

| | |
|---|---|
| ***G03G 15/00*** | (2006.01) |
| ***B65H 3/06*** | (2006.01) |
| ***B65H 3/66*** | (2006.01) |
| ***B65H 5/06*** | (2006.01) |

(52) U.S. Cl.

CPC ..... *G03G 15/6529* (2013.01); *B65H 3/0684* (2013.01); *B65H 3/66* (2013.01); *B65H 5/062* (2013.01); *B65H 2801/06* (2013.01)

(58) Field of Classification Search

CPC ..... B65H 3/0684; B65H 3/66; B65H 3/0607; B65H 3/0676; B65H 3/5261; G03G 15/6529; G03G 15/6511

USPC ..... 271/10.11, 110, 117, 118, 125, 127

See application file for complete search history.

(56) References Cited

U.S. PATENT DOCUMENTS

| | | | | |
|---|---|---|---|---|
| 2009/0079127 | A1* | 3/2009 | Bokelman | B65H 3/0684 271/121 |
| 2010/0025916 | A1* | 2/2010 | Kusumi | B65H 3/047 271/10.06 |
| 2012/0133095 | A1* | 5/2012 | Tu | B65H 3/0684 271/256 |
| 2014/0319756 | A1* | 10/2014 | Hirahara | B65H 3/0684 271/117 |
| 2015/0329302 | A1* | 11/2015 | Hayashi | B65H 1/04 271/117 |

(Continued)

FOREIGN PATENT DOCUMENTS

JP 2006-327727 A 12/2006

*Primary Examiner* — David H Bollinger

(74) *Attorney, Agent, or Firm* — Buchanan Ingersoll & Rooney PC

(57) ABSTRACT

A paper feed device of an image forming apparatus includes: a pickup roller which contacts, from above, the uppermost sheet of sheets stacked in a paper feed cassette so as to feed out the sheet; a paper feed roller which further feeds the sheet to the downstream side in a transport direction; and a pickup holder which supports the pickup roller. The pickup roller and the paper feed roller are cantilever-supported at one ends of shaft portions which penetrate the centers of shaft lines. On the free ends of the shaft portions thereof, a transport guide member is provided that includes: a roller movement regulation portion which holds the shaft portions and which regulates the movements of the rollers in the direction of the shaft lines; and a sheet guide portion which guides the transport of the sheet between the pickup roller and the paper feed roller.

9 Claims, 10 Drawing Sheets

(56) References Cited

U.S. PATENT DOCUMENTS

| | | | | |
|---|---|---|---|---|
| 2016/0137439 | A1* | 5/2016 | Kobayashi | G03G 15/6511 271/117 |
| 2016/0177989 | A1* | 6/2016 | Alagos | F16B 7/042 271/117 |
| 2017/0017185 | A1* | 1/2017 | Woo | G03G 15/6529 |
| 2017/0031295 | A1* | 2/2017 | Matsumoto | B65H 29/22 |

* cited by examiner

PAPER FEED DEVICE AND IMAGE FORMING APPARATUS

This application is based on Japanese Patent Application No. 2015-190704 filed on Sep. 29, 2015, the contents of which are hereby incorporated by reference.

BACKGROUND OF THE INVENTION

Field of the Invention

The present invention relates to a paper feed device and an image forming apparatus, such as a copying machine, that includes such a paper feed device.

Description of the Related Art

In image forming apparatuses such as a copying machine, a printer and a facsimile machine, a paper feed device is provided. In some paper feed devices, sheets are separated and supplied one by one from the uppermost sheet of sheets stacked on the upper surface of a push-up plate or the like in a sheet storage portion. The sheet is fed out by a pick-up roller which makes contact with, from above, the uppermost sheet of the sheets stacked in the sheet storage portion, and a paper feed roller which receives the sheet further feeds it to the downstream side in a transport direction.

Here, when an inflexible and relatively thin sheet or a curled sheet is fed out from the sheet storage portion, the sheet may enter between the pickup roller and the paper feed roller. Thus, a downstream end of the sheet in the transport direction makes contact with an unintended portion of the paper feed roller, with the result that disadvantageously, the downstream portion of the sheet in the transport direction may be bent or a paper jam may occur. Hence, a technology for guiding the downstream end of the sheet in the transport direction fed out by the pickup roller to a predetermined portion of the paper feed roller is proposed, and an example of the conventional technology thereof is disclosed in Japanese Unexamined Patent Application Publication No. 2006-327727.

The paper feed device disclosed in Japanese Unexamined Patent Application Publication No. 2006-327727 includes a transport guide member which guides the transport of the sheet between the pickup roller and the paper feed roller. In this way, the downstream end of the sheet in the transport direction fed out by the pickup roller is guided to the predetermined portion of the paper feed roller, and thus the bending of the sheet or the paper jam is prevented from occurring in the portion of the paper feed roller, with the result that stable transport performance is maintained.

However, since in the paper feed device disclosed in Japanese Unexamined Patent Application Publication No. 2006-327727, the transport guide member is attached to the shaft portion of the paper feed roller, a retaining ring is needed. Hence, disadvantageously, it is inconvenient and troublesome to attach the transport guide member. Furthermore, since the retaining ring is a relatively small component, it is highly likely that the retaining ring is dropped into the image forming apparatus. Thus, the retaining ring may enter a portion where the retaining ring can cause a failure so as to damage the apparatus.

The present invention is made in view of the foregoing respects and has an object to provide a paper feed device and an image forming apparatus which can transport, with a simpler configuration, a sheet between a pickup roller and a paper feed roller in a suitable manner so as to enhance sheet transport performance.

SUMMARY OF THE INVENTION

In order to solve the above problem, a paper feed device according to the present invention includes: a pickup roller which makes contact with, from above, the uppermost sheet of sheets stacked in a sheet storage portion so as to feed out the sheet; a paper feed roller which receives the sheet fed out by the pickup roller and which further feeds the sheet to a downstream side in a transport direction; and a pickup holder which supports the pickup roller, where the pickup roller and the paper feed roller are cantilever-supported at one ends of shaft portions which penetrate the centers of shaft lines, and on the side of free ends of the shaft portions of the pickup roller and the paper feed roller, a transport guide member is provided that includes: a roller movement regulation portion which holds the shaft portions and which regulates the movements of the rollers in the direction of the shaft lines; and a sheet guide portion which guides the transport of the sheet between the pickup roller and the paper feed roller.

In the paper feed device configured as described above, the transport guide member makes a distance between the shaft lines of the pickup roller and the paper feed roller on the side of the free ends of the shaft portions of the pickup roller and the paper feed roller equal to a distance between the shaft lines on the side of support ends and holds the shaft portions.

In the paper feed device configured as described above, the transport guide member includes, on the side of support ends of the shaft portions of the pickup roller and the paper feed roller, an engagement portion for engaging with the pickup holder.

In the paper feed device configured as described above, the pickup holder includes, in a position corresponding to the engagement portion, a protrusion portion which has a bent portion whose tip end is bent upward, and the transport guide member includes an opening portion which receives a tip end of the protrusion portion including the bent portion of the pickup holder.

In the paper feed device configured as described above, the transport guide member includes, in the engagement portion, a first displacement regulation portion which makes contact with the protrusion portion to regulate the upward displacement of the transport guide member.

In the paper feed device configured as described above, the transport guide member includes, in the engagement portion, a second displacement regulation portion which makes contact with the protrusion portion to regulate the displacement of the transport guide member along the transport direction of the sheet.

In the paper feed device configured as described above, in the transport guide member, the sheet guide portion includes a flat surface portion which is away from a tangent that is common to the circumferential surfaces of the pickup roller and the paper feed roller to an inner side in the radial direction of the rollers.

In the paper feed device configured as described above, the transport guide member includes an inclination portion which is inclined so as to be moved upward as an upstream portion of the sheet guide portion in a sheet transport direction is moved to the upstream side in the sheet transport direction.

In the present invention, an image forming apparatus includes the paper feed device configured as described above.

DESCRIPTION OF PREFERRED EMBODIMENTS

An embodiment of the present invention will be described below with reference to drawings. The present invention is not limited to the details which will be described below.

Figure 1:
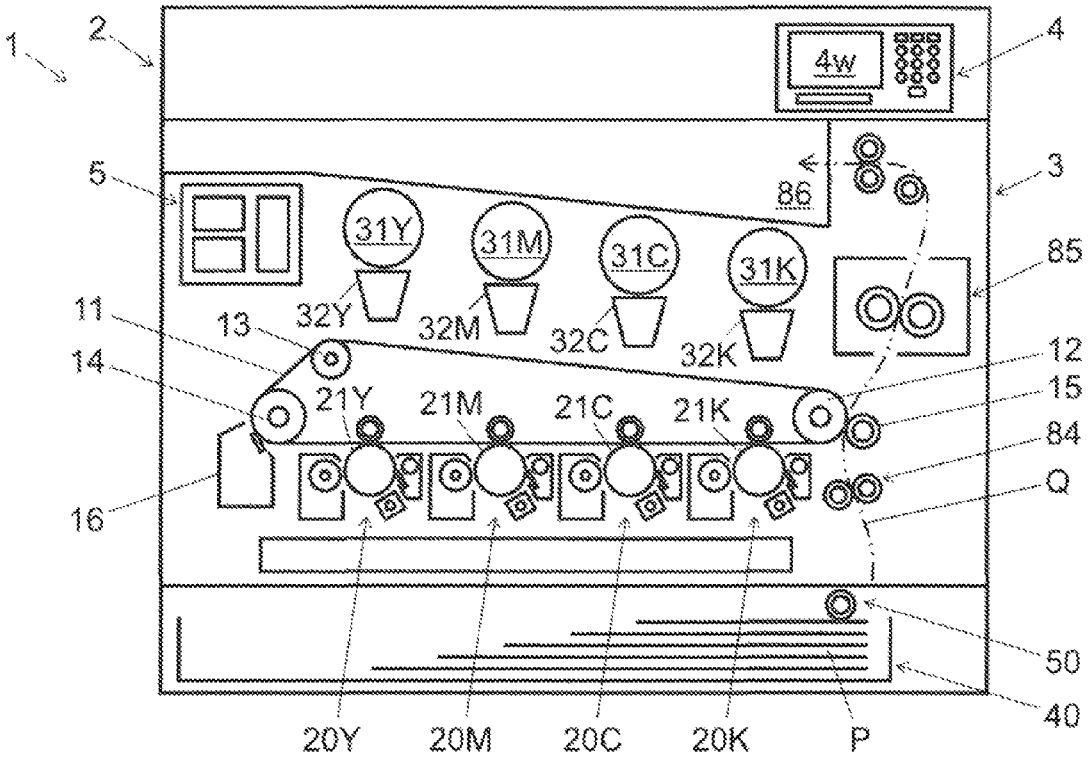
FIG. 1 A partial vertical cross-sectional front view of an image forming apparatus according to an embodiment of the present invention.

An image output operation will first be described while the schematic structure of an image forming apparatus according to the embodiment of the present invention is being described with reference to FIG. 1. FIG. 1 is an example of a partial vertical cross-sectional front view of the image forming apparatus. A chain double-dashed line with an arrow in the figure indicates the transport route and the transport direction of a sheet.

The image forming apparatus 1 is a so-called tandem-type color copying machine as shown in FIG. 1, and includes an image reading portion 2 which reads an image of an original document, a print portion 3 which prints the read image on a transfer member such as a sheet, an operation portion 4 for inputting print conditions and displaying an operational status and a main control portion 5.

The image reading portion 2 is a known one that reads the image of the original document placed on the upper surface of an unillustrated platen glass by moving an unillustrated scanner. The image of the original document is divided into three colors of red (R), green (G) and blue (B), and they are converted with an unillustrated CCD (Charge Coupled Device) image sensor into electrical signals. In this way, the image reading portion 2 obtains image data on the individual colors of red (R), green (G) and blue (B).

The main control portion 5 performs various types of processing on the image data on the individual colors obtained by the image reading portion 2, the image data is converted into image data on the individual reproduction colors of yellow (Y), magenta (M), cyan (C) and black (K) and the image data is stored in an unillustrated memory within the main control portion 5. The image data on the individual reproduction colors stored in the memory is subjected to processing for displacement correction, and is thereafter read per scanning line in synchronization with the transport of the sheet so that light scanning is performed on a photosensitive drum 21 serving as an image carrying member.

The print portion 3 forms an image with an electrophotographic system, and transfers the image to the sheet or the like. The print portion 3 includes an intermediate transfer belt 11 in which an intermediate transfer member is formed as an endless belt. The intermediate transfer belt 11 is wound on a drive roller 12, a tension roller 13 and a driven roller 14. The tension roller 13 receives a force acting upward in FIG. 1 exerted by an unillustrated spring, and thus a tension is applied to the intermediate transfer belt 11. The intermediate transfer belt 11 is moved to rotate counterclockwise in FIG. 1 by the drive roller 12.

The drive roller 12 is pressed onto a secondary transfer roller 15 which is opposite the drive roller 12 through the intermediate transfer belt 11. In the place of the driven roller 14, an intermediate transfer cleaning portion 16 which is provided opposite the driven roller 14 through the intermediate transfer belt 11 is brought into contact with the outer circumferential surface of the intermediate transfer belt 11. The intermediate transfer cleaning portion 16 performs cleaning by scraping the toner left on the outer circumferential surface of the intermediate transfer belt 11 after secondary transfer.

Below the intermediate transfer belt 11, image formation portions 20Y, 20M, 20C and 20K corresponding to the individual reproduction colors of yellow (Y), magenta (M), cyan (C) and black (K) are provided. In the following description, unless it is necessary to particularly provide a limitation, the identification symbols of "Y", "M", "C" and "K" are omitted, and for example, they may be collectively referred to as "image formation portions 20". The four image formation portions 20 are arranged in line from the upstream side to the downstream side in the rotation direction along the rotation direction of the intermediate transfer belt 11. The configurations of the four image formation portions 20 are the same as each other, and the image formation portion 20 includes, therearound, a charging portion, an exposure portion, a development portion, a cleaning portion and a primary transfer roller with the photosensitive drum 21 rotated clockwise in FIG. 1 in the center thereof.

Above the intermediate transfer belt 11, toner bottles 31 and toner hoppers 32 corresponding to the four image formation portions 20 of the individual reproduction colors are provided. An unillustrated toner remaining amount detection portion is provided which detects the amount of toner within each of the development portions and the toner hoppers 32. An unillustrated toner supply device is individually provided between the development portion and the toner hopper 32 and between the toner hopper 32 and the toner bottle 31. When the remaining amount detection portion detects that the amount of toner within the development portion is lowered, the supply device is driven such that the toner is supplied from the toner hopper 32 to the development portion. Furthermore, when the remaining amount detection portion detects that the amount of toner within the toner hopper 30 is lowered, the supply device is driven such that the toner is supplied from the toner bottle 31 to the toner hopper 32. The toner bottle 31 is removable with respect to an apparatus main body, and the toner bottle 31 can be replaced with a new one as necessary.

Below the four image formation portions 20, a paper feed device 40 is provided, and sheets P are stored therewithin. The sheets P stored within the paper feed device 40 are fed by a supply portion 50 sequentially from the uppermost sheet thereof to a sheet transport path Q. The sheet P fed from the paper feed device 40 to the sheet transport path Q reaches the place of a registration roller pair 84. Then, while the registration roller pair 84 corrects the oblique feeding of the sheet P (skew correction), the registration roller pair 84 feeds out, in synchronization with the rotation of the intermediate transfer belt 11, the sheet P to a contact portion (secondary transfer nip portion) between the intermediate transfer belt 11 and the secondary transfer roller 15.

In the image formation portion 20, an electrostatic latent image is formed on the surface of the photosensitive drum 21 with the charging portion and the exposure portion, and the electrostatic latent image is visualized as the toner image with the development portion. The toner image formed on the surface of the photosensitive drum 21 is primarily transferred to the outer circumferential surface of the intermediate transfer belt 11 in a place where the photosensitive drum 21 is opposite the primary transfer roller through the intermediate transfer belt 11. Then, as the intermediate transfer belt 11 is rotated, the toner images of the image formation portions 20 are sequentially transferred to the intermediate transfer belt 11 with predetermined timing, and thus a color toner image in which the toner images of the four colors of yellow, magenta, cyan and black are overlapped is formed on the outer circumferential surface of the intermediate transfer belt 11.

The color toner image primarily transferred to the outer circumferential surface of the intermediate transfer belt 11 is transferred to the sheet P fed by the registration roller pair 84 in synchronization therewith in the secondary transfer nip portion formed by bringing the intermediate transfer belt 11 into contact with the secondary transfer roller 15.

Above the secondary transfer nip portion, a fixing device 85 is provided. The sheet P to which an unfixed toner image is transferred in the secondary transfer nip portion is fed to the fixing device 85, and is sandwiched between a heating roller and a pressure roller, and the toner image is heated and pressurized so as to be fixed to the sheet P. The sheet P passing through the fixing device 85 is ejected to a sheet ejection portion 86 provided above the intermediate transfer belt 11.

The operation portion 4 is provided on the side of the front surface of the image reading portion 2. The operation portion 4 receives, for example, inputs of settings such as print conditions such as the type and size of sheet P used for printing, enlargement and reduction and whether or not double-side printing is performed and inputs of settings such as a fax number and the name of a sender in facsimile transmission which are made by a user. The operation portion 4 also displays, on a display portion 4*w*, for example, the state of the apparatus, cautions, an error message and the like, and thereby also functions as a notification portion for notifying them to the user.

In order to control the overall operation of the image forming apparatus 1, the main control portion 5 which is formed with a CPU, an image processing portion and electronic components that are not illustrated is provided in the image forming apparatus 1. The main control portion 5 utilizes the CPU which is a central processing unit and the image processing portion to control constituent elements such as the image reading portion 2 and the print portion 3 based on programs and data stored and input in the memory, and thereby realizes a series of image formation operations and print operations.

Figure 2:
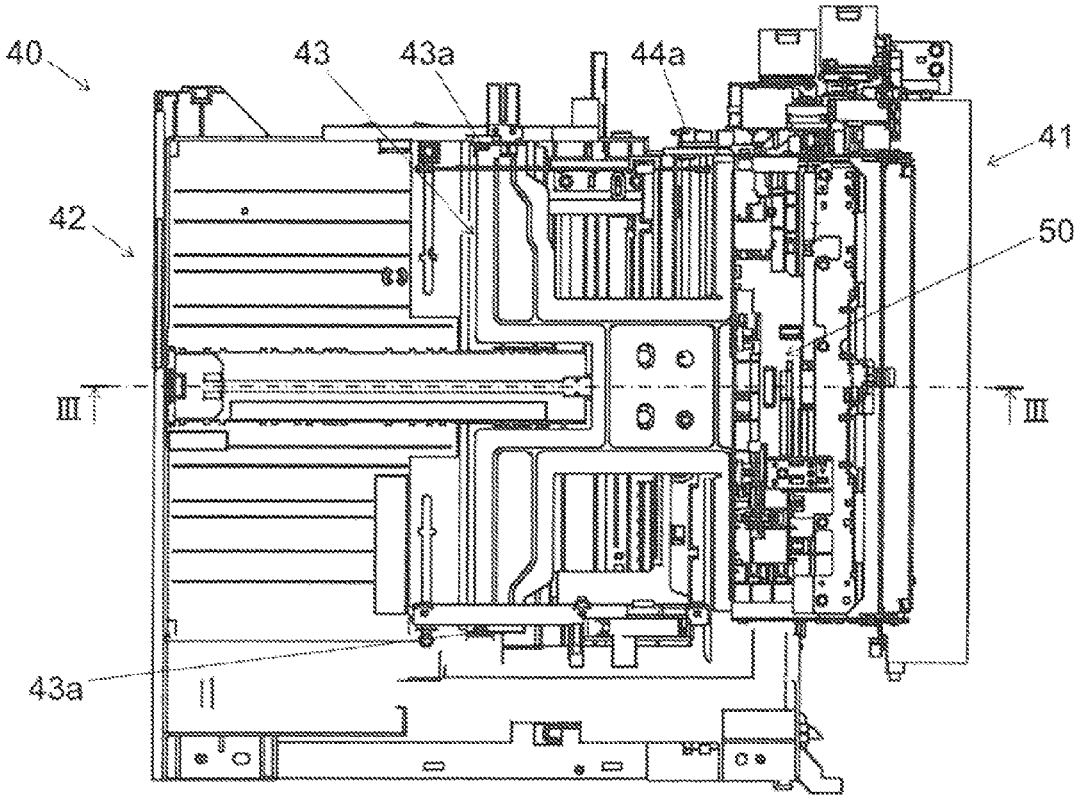
FIG. 2 A top view of a paper feed device of the image forming apparatus according to the embodiment of the present invention.
Figure 3:
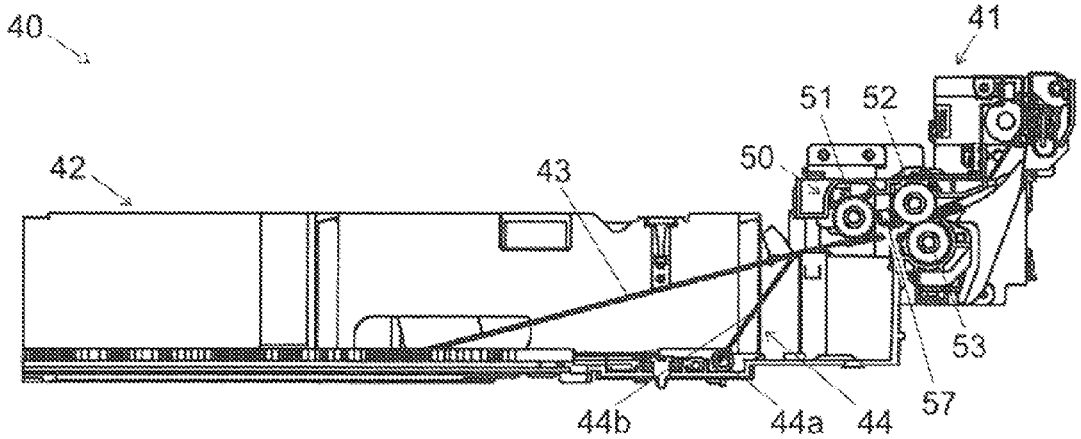
FIG. 3 A vertical cross-sectional front view of the paper feed device of the image forming apparatus according to the embodiment of the present invention.
Figure 4:
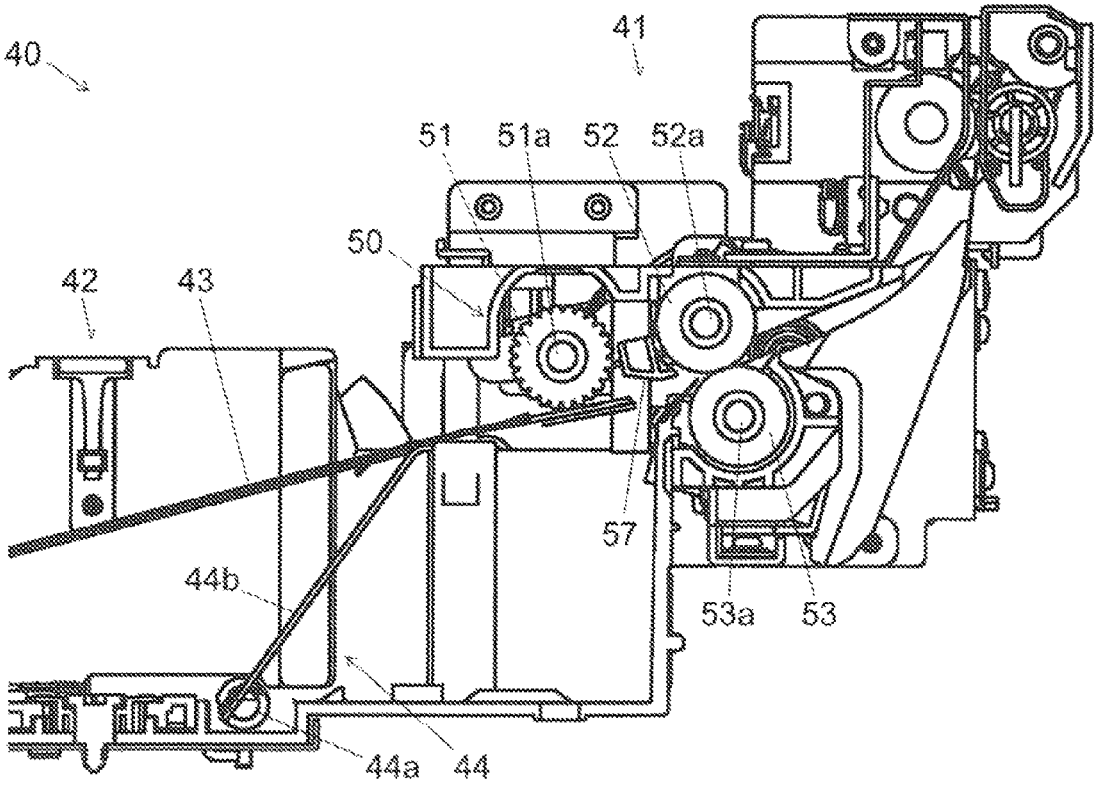
FIG. 4 A partially enlarged vertical cross-sectional front view of the paper feed device according to the embodiment of the present invention.
Figure 5:
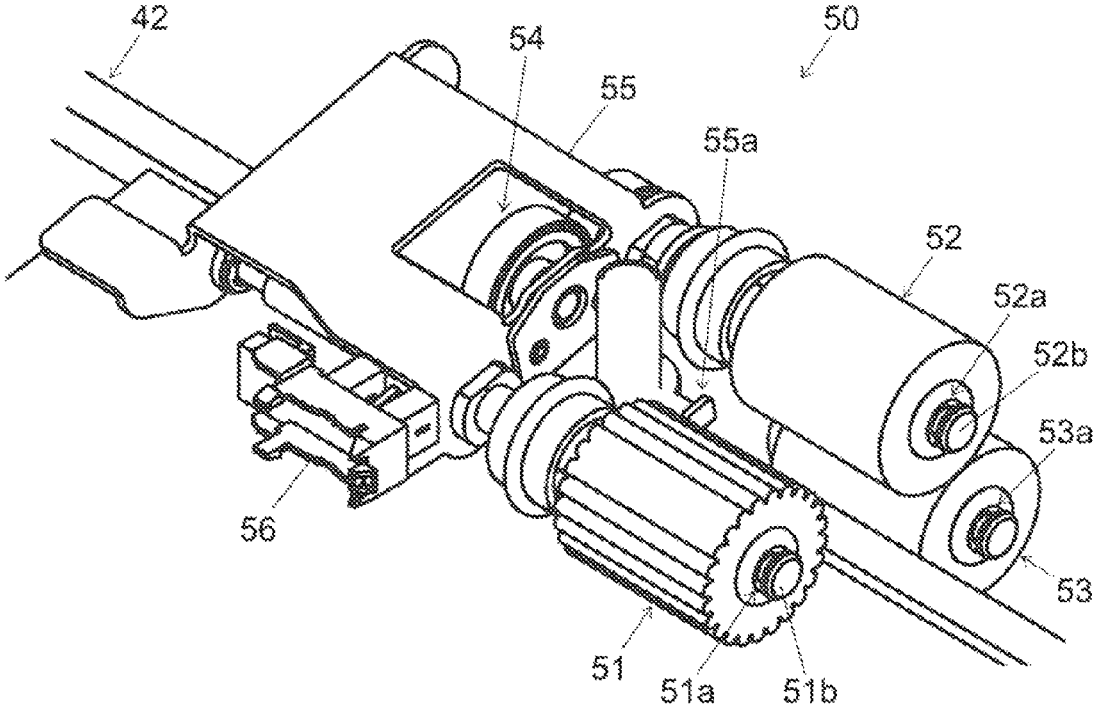
FIG. 5 A perspective view of a supply portion of the paper feed device according to the embodiment of the present invention.
Figure 6:
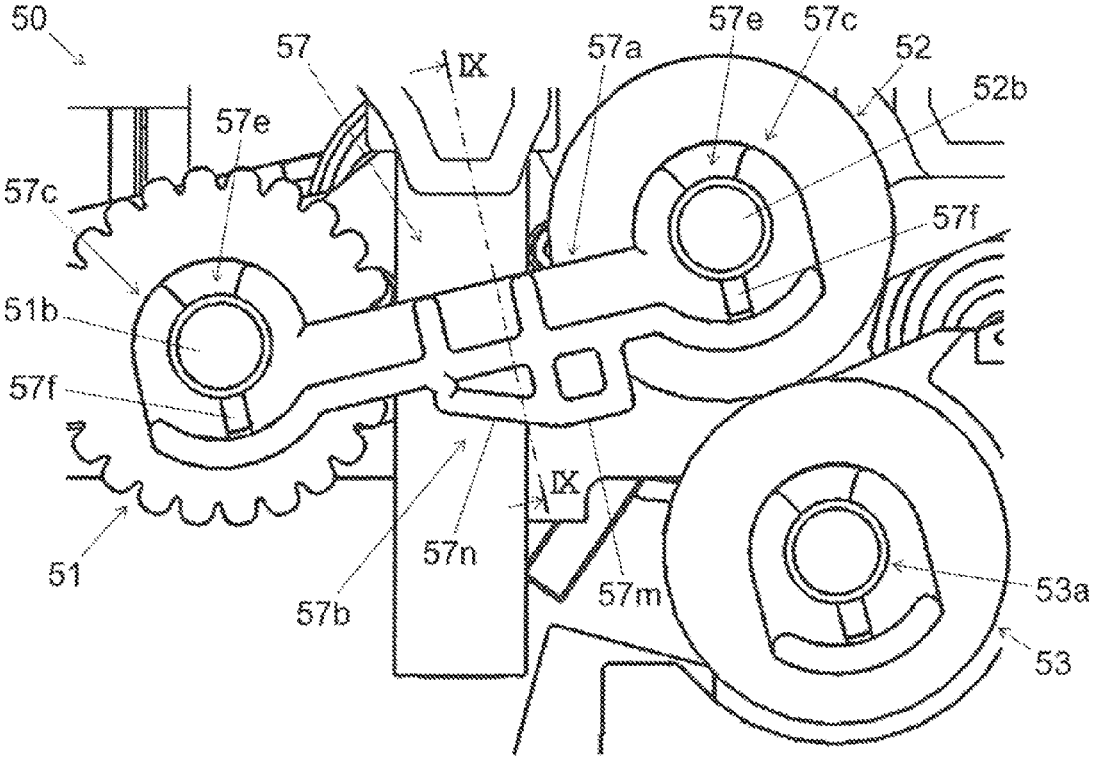
FIG. 6 A front view of the supply portion of the paper feed device according to the embodiment of the present invention.

The configuration of the paper feed device 40 in the image forming apparatus 1 will then be described with reference to FIGS. 2 to 6. FIGS. 2, 3 and 4 are respectively a top view, a vertical cross-sectional front view and a partially enlarged vertical cross-sectional front view of the paper feed device 40. FIGS. 5 and 6 are respectively a perspective view and a front view of the supply portion 50 of the paper feed device 40. FIGS. 3 and 4 are vertical cross-sectional views taken along line shown in FIG. 2. In the supply portion 50 shown in FIG. 5, the transport guide member which will be described later is not illustrated. The lower side of FIG. 2 is the side of the front surface (front side) of the paper feed device 40, and the upper side of FIG. 2 is the side of the back surface (back side) of the paper feed device 40. The up/down direction of FIG. 3 is the up/down direction of the paper feed device 40, and the left/right direction of FIG. 3 is the left/right direction of the paper feed device 40.

As shown in FIGS. 2 and 3, the paper feed device 40 includes a housing portion 41 and a paper feed cassette 42. The paper feed cassette 42 is a sheet storage portion in which sheets such as cut paper before printing are stacked and stored. The paper feed cassette 42 is formed in the shape of a flat box whose upper surface is open, and sheets are stacked and stored from the direction of the upper surface. The sheet is fed out toward the right side of FIGS. 2 and 3 with respect to the paper feed cassette 42 by the operation of the supply portion 50 which will be describe in detail later.

The paper feed cassette 42 can be made to slide horizontally with respect to the housing portion 41 along an unillustrated guide portion which is provided so as to be extended in a front/back direction between the paper feed cassette 42 and the housing portion 41. The paper feed cassette 42 is pulled out or pushed in the front/back direction with respect to the housing portion 41, and thus the paper feed cassette 42 can be removed or attached.

On the inner bottom surface of the paper feed cassette 42, a push-up plate 43 is arranged. The sheets are placed and stacked on the push-up plate 43. The push-up plate 43 is supported on the inner bottom surface of the paper feed cassette 42 by a support shaft 43*a* which is provided at an upstream end in the sheet transport direction, that is, an end portion on the left side in FIG. 2 and which is extended in the front/back direction. The push-up plate 43 can be swung within a vertical plane about the support shaft 43*a* with the downstream end (the end portion on the right side) being a free end, and the inclination angle of the sheets with respect to the transport direction is changed according to the number of sheets stacked on the upper surface. The support shaft 43*a* is provided at two places on the side of the front surface and the side of the back surface in the push-up plate 43.

Below the downstream portion of the push-up plate 43 in the sheet transport direction, a lift mechanism 44 for the push-up plate 43 is arranged between the downstream portion and the inner bottom surface of the paper feed cassette 42 (see FIGS. 3 and 4). The lift mechanism 44 includes a rotation shaft 44*a* and a lift lever 44*b*. The rotation shaft 44*a* is extended along the inner bottom surface of the paper feed cassette 42 in the front/back direction, and the lift lever 44*b* is fixed to the end portion on the front side thereof. The lift lever 44*b* is arranged in the center portion of the push-up plate 43 in the front/back direction, one end in the sheet transport direction is fixed to the lift lever 44*b* and the other end is in contact with the lower surface of the downstream portion of the push-up plate 43 in the sheet transport direction. The end portion of the rotation shaft 44*a* on the back side is further protruded from the back surface of the paper feed cassette 42 toward the back side (see FIG. 2).

When the paper feed cassette 42 is fitted to the housing portion 41, the end portion of the rotation shaft 44*a* on the back side is coupled to a drive portion (not shown) which is provided in the housing portion 41. Then, when the drive portion is operated, the rotation shaft 44*a* and the lift lever 44*b* are rotated, and thus the downstream portion of the push-up plate 43 in the sheet transport direction is pushed up by the lift lever 44*b*. When the paper feed cassette 42 is pulled out from the housing portion 41 to cancel the coupling of the rotation shaft 44*a* and the drive portion, the push-up plate 43 falls down on the inner bottom surface of the paper feed cassette 42.

Above the downstream portion of the paper feed cassette 42 in the sheet transport direction, the supply portion 50 is arranged in the housing portion 41. The supply portion 50 feeds out the sheet in the paper feed cassette 42 to the outside of the paper feed cassette 42. As shown in FIGS. 3 to 6, the supply portion 50 includes a pickup roller 51, a paper feed roller 52, a separation roller 53, a drive mechanism 54, a pickup holder 55, an upper limit sensor 56 and a transport guide member 57.

The pickup roller 51, the paper feed roller 52 and the separation roller 53 are provided so as to be extended along a direction in which shaft portions 51*a*, 52*a* and 53*a* penetrating the centers of the shaft lines thereof intersect the sheet transport direction, that is, along the front/back direction of the paper feed device 40. In the shaft portions 51*a*, 52*a* and 53*a* of the pickup roller 51, the paper feed roller 52 and the separation roller 53, one end on the back side is used as a support end, the other end on the front side is used as a free end and thus the rollers are cantilever-supported.

The pickup roller 51 is arranged above the downstream portion of the push-up plate 43 in the sheet transport direction. The downstream portion of the sheets stacked on the paper feed cassette 42 is raised from below the pickup roller 51 by the push-up plate 43, and the uppermost sheet of the sheets presses the pickup roller 51 from below so as to make contact therewith. The sheet in the paper feed cassette 42 is delivered by the pickup roller 51 to the paper feed roller 52 and is fed by the paper feed roller 52 to the outside of the paper feed cassette 42.

The paper feed roller 52 is arranged on the downstream side of the pickup roller 51 in the sheet transport direction. The paper feed roller 52 is provided such that the lower portion of the front surface thereof is protruded to the sheet transport path Q which is extended from the paper feed device 40 to the outside thereof. The paper feed roller 52 is coupled to an unillustrated motor provided in the housing portion 41 of the paper feed device 40 and is rotated.

Between the paper feed roller 52 and the pickup roller 51, the drive mechanism 54 for the pickup roller 51 is arranged. The drive mechanism 54 includes a plurality of gears which are coupled to each other, and the paper feed roller 52 and the pickup roller 51 are coupled to each other through the drive mechanism 54. When the paper feed roller 52 is rotated by the motor, the pickup roller 51 is also rotated by the drive mechanism 54 in the same direction as the paper feed roller 52 at the same circumferential velocity as the paper feed roller 52.

The shaft portions 51*a* and 52*a* of the pickup roller 51 and the paper feed roller 52 are rotatably supported by the pickup holder 55. The pickup holder 55 is provided in the housing portion 41 such that the pickup holder 55 can be swung about the shaft portion 52*a* of the paper feed roller 52 within the vertical plane. In this way, the portion of the pickup roller 51 in the pickup holder 55 can be swung about the shaft portion 52*a* of the paper feed roller 52 within the vertical plane.

The portion of the pickup roller 51 in the pickup holder 55 receives a force acting downward by an unillustrated force application member or by the action of gravity. Whether or not the uppermost sheet of the sheets raised by the lift mechanism 44 for the push-up plate 43 makes contact with the pickup roller 51 is detected by the upper limit sensor 56. The upper limit sensor 56 is formed with, for example, a transmission-type light sensor, and detects that a predetermined portion of the pickup holder 55 is moved upward to shield the optical path thereof. For example, when the sheets are placed on the push-up plate 43, the upper limit sensor 56 detects, by the upward movement of the pickup holder 55, that the uppermost sheet of the sheets makes contact with the pickup roller 51. Then, the upward movement of the push-up plate 43 by the lift mechanism 44 is stopped, and the uppermost sheet of the sheets is set in a predetermined paper feed position where the uppermost sheet makes contact with the pickup roller 51.

The separation roller 53 is arranged below the paper feed roller 52 through the sheet transport path Q. The separation roller 53 is pressed onto the paper feed roller 52 by the action of an unillustrated force application member so as to make contact therewith. The sheet is inserted into a nip portion formed by bringing the separation roller 53 into contact with the paper feed roller 52. The separation roller 53 is not coupled to the motor but makes contact with the paper feed roller 52 so as to be rotated as the paper feed roller 52 is rotated.

On the shaft portion 53*a* of the separation roller 53, for example, a torque limiter (not shown) is provided. When the sheet is not present in the nip portion formed by bringing the separation roller 53 into contact with the paper feed roller 52 or when only one sheet enters the nip portion, a torque which is equal to or more than a torque set for the torque limiter is applied to the separation roller 53, and thus the separation roller 53 is rotated by the paper feed roller 52 in the direction in which the sheet is fed out. On the other hand, when a plurality of sheets which are overlaid enter the nip portion, the torque applied to the separation roller 53 is less than the torque set for the torque limiter, and thus the separation roller 53 stops the rotation. In this way, since the lower sheet of the sheets overlaid is not fed out, it is possible to prevent the problem in which the sheets overlaid are fed out.

The transport guide member 57 is arranged between the pickup roller 51 and the paper feed roller 52. The transport guide member 57 is attached to the pickup holder 55, and is displaced as the pickup holder 55 is displaced. The transport guide member 57 guides the transport of the sheet such that the sheet fed out by the pickup roller 51 reaches, without fail, the nip portion formed by bringing the separation roller 53 into contact with the paper feed roller 52.

Figure 7:
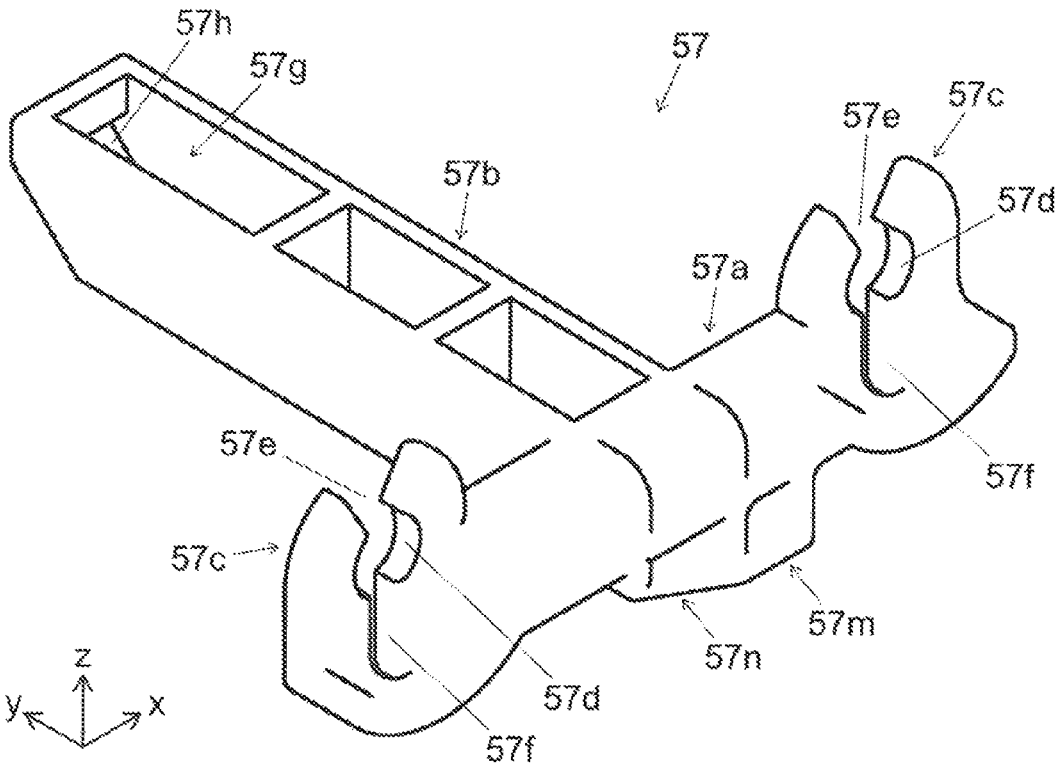
FIG. 7 An external perspective view of a transport guide member of the paper feed device according to the embodiment of the present invention.
Figure 8:
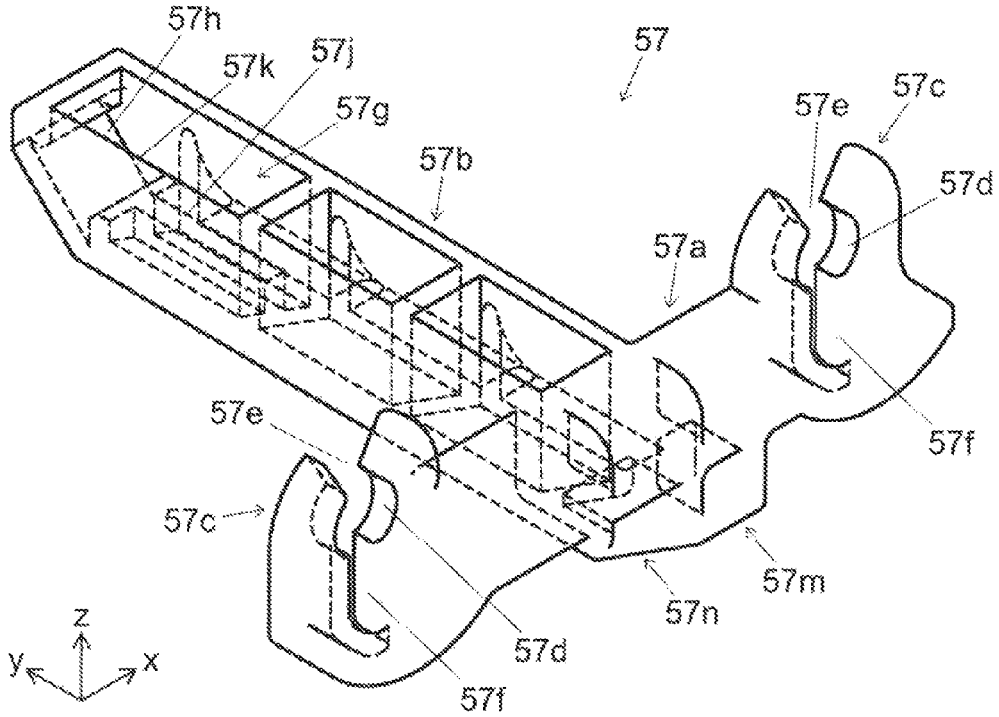
FIG. 8 A perspective view of the transport guide member of the paper feed device according to the embodiment of the present invention, showing a state where its internal structure is shown.
Figure 9:
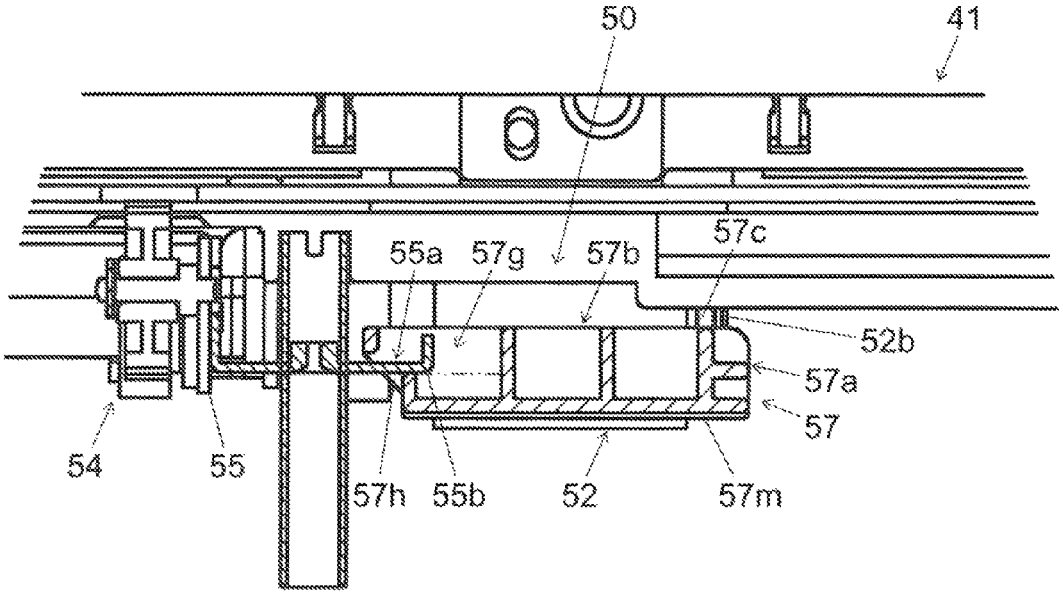
FIG. 9 A side view of the supply portion of the paper feed device according to the embodiment of the present invention.
Figure 10:
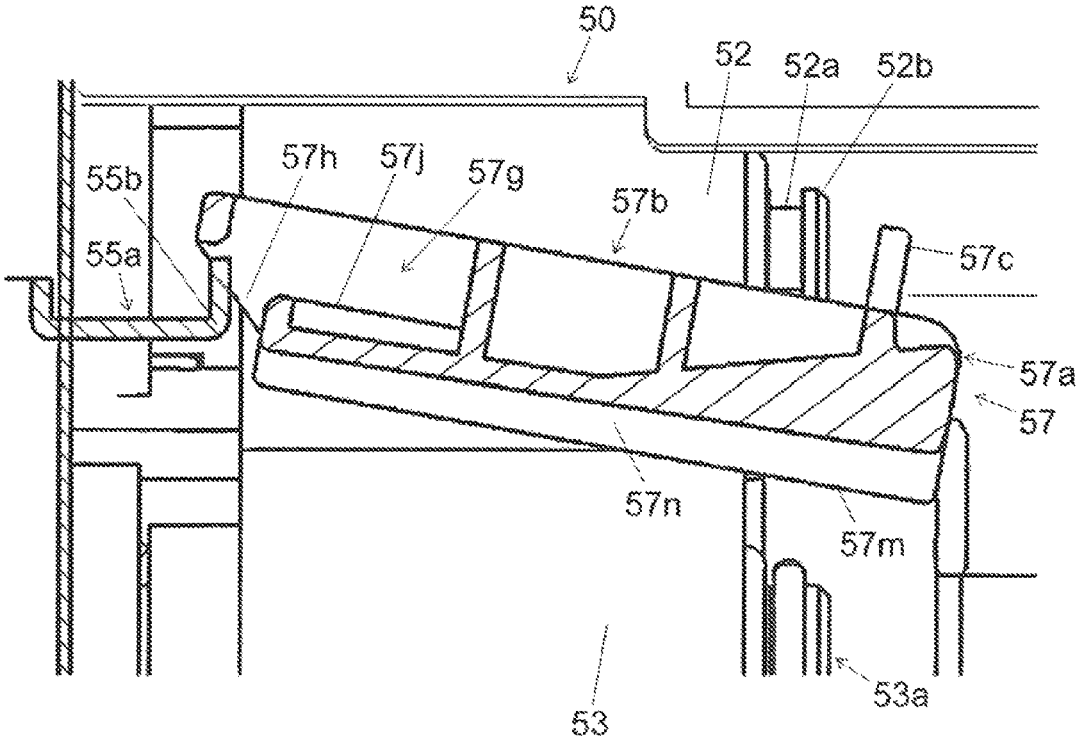
FIG. 10 A side view of the supply portion of the paper feed device according to the embodiment of the present invention, showing the first stage of the attachment of the transport guide member to a pickup holder.
Figure 11:
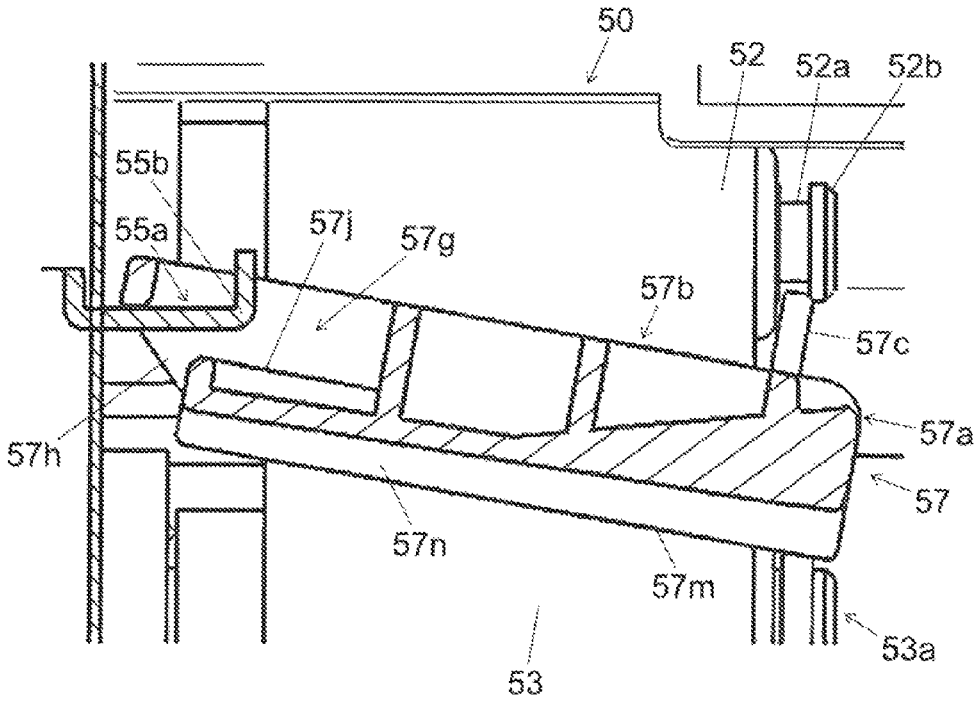
FIG. 11 A side view of the supply portion of the paper feed device according to the embodiment of the present invention, showing the second stage of the attachment of the transport guide member to the pickup holder.
Figure 12:
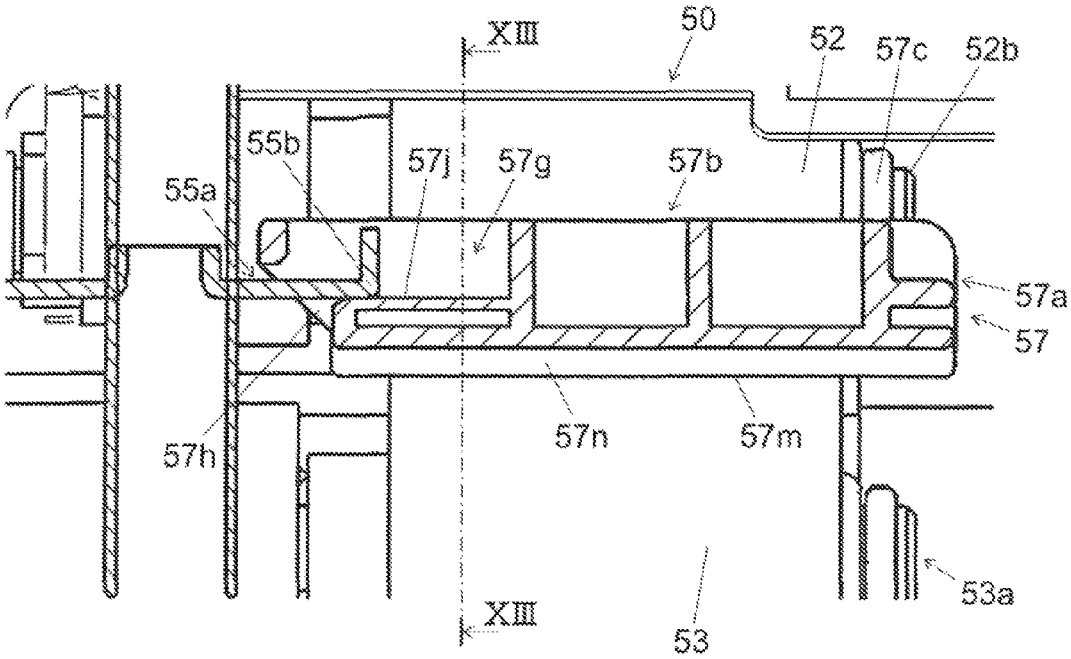
FIG. 12 A side view of the supply portion of the paper feed device according to the embodiment of the present invention, showing the final stage of the attachment of the transport guide member to the pickup holder.
Figure 13:
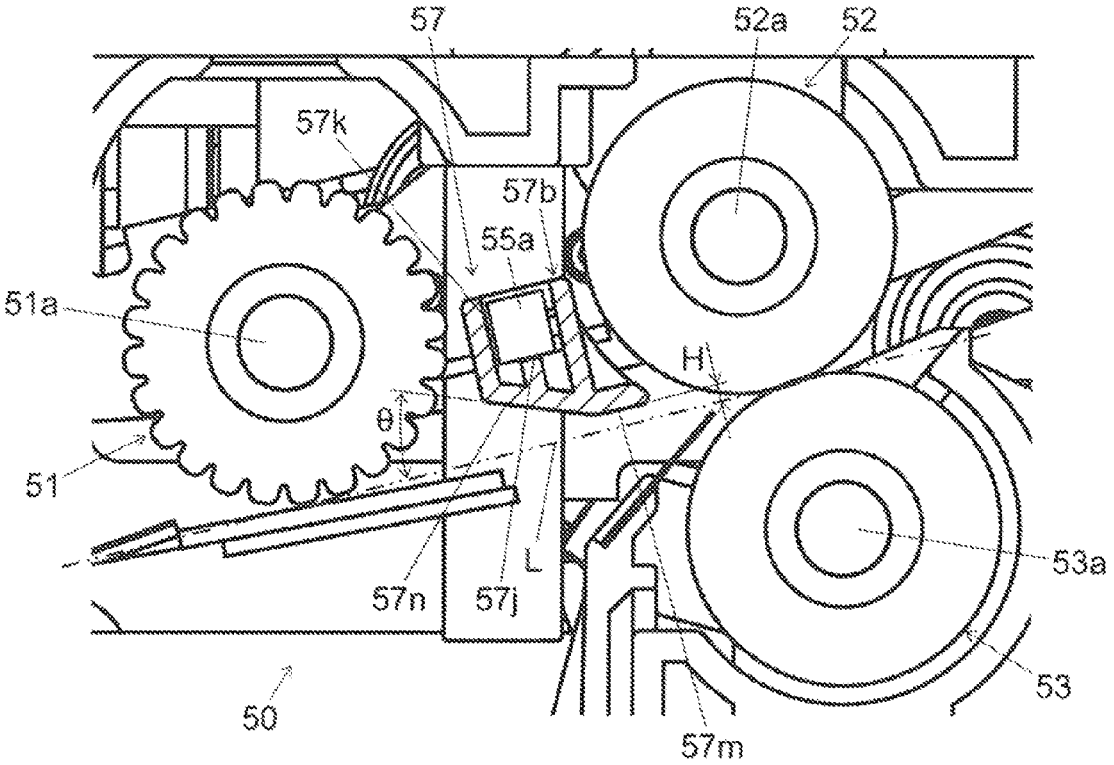
FIG. 13 A vertical cross-sectional front view of the supply portion of the paper feed device according to the embodiment of the present invention.

The detailed structure of the transport guide member 57 will then be described with reference to not only FIGS. 5 and 6 but also FIGS. 7 to 13. FIGS. 7 and 8 are an external perspective view of the transport guide member 57 and a perspective view showing the internal structure thereof. FIG. 9 is a side view of the supply portion 50. FIGS. 10, 11 and 12 are side views of the supply portion 50 showing the first stage, the second stage and the final stage of the attachment of the transport guide member 57 to the pickup holder 55. FIG. 13 is a vertical cross-sectional front view of the supply portion 50. FIG. 9 is a diagram when in the direction in which the sheet is transported by the paper feed device 40, the supply portion 50 is seen from the upstream side thereof, and is a cross-sectional view taken along line IX-IX shown in FIG. 6 (where the separation roller 53 is not illustrated). FIG. 13 is a cross-sectional view taken along line XIII-XIII shown in FIG. 12.

As shown in FIGS. 7 and 8, the transport guide member 57 is a member which is formed in the shape of the letter T when seen in an up/down direction (z direction in FIGS. 7 and 8), and includes a roller movement regulation portion 57*a* and a sheet guide portion 57*b*.

The roller movement regulation portion 57*a* is extended along the sheet transport direction (x direction in FIGS. 7 and 8) from the portion of the shaft portion 51*a* in the pickup roller 51 to the portion of the shaft portion 52*a* in the paper feed roller 52 (see FIG. 6). In each of the portions of the roller movement regulation portion 57*a* corresponding to the shaft portions 51*a* and 52*a*, a holding portion 57*c* is provided.

The holding portion 57*c* includes a shaft reception portion 57*d* which receives the shaft portion 51*a* or 52*a* and an insertion portion 57*e* for attaching and removing the shaft portion 51*a* or 52*a* with respect to the shaft reception portion 57*d*. The shaft reception portion 57*d* is formed in the shape of a cylinder which penetrates the roller movement regulation portion 57*a* in a direction (y direction in FIGS. 7 and 8) intersecting the sheet transport direction, and has such a diameter that the shaft portion 51*a* or 52*a* can be received. The insertion portion 57*e* is open above the shaft reception portion 57*d* so as to have a length in the sheet transport direction (x direction in FIGS. 7 and 8) shorter than the diameter of the shaft reception portion 57*d* and the diameters of the shaft portions 51*a* and 52*a*. The holding portions 57*c* hold the shaft portions 51*a* and 52*a* with a distance between shaft lines on the side of the free ends of the shaft portions 51*a* and 52*a* equal to a distance between shaft lines on the side of the support ends thereof.

On the other hand, on the free ends of the shaft portions 51*a* and 52*a* in the pickup roller 51 and the paper feed roller 52, as shown in FIGS. 5, 6 and 10, locking portions 51*b* and 52*b* are provided. The locking portions 51*b* and 52*b* are formed in the shape of a disc which has a diameter larger than the diameter of the shaft reception portion 57*d* of the holding portion 57*c* in the roller movement regulation portion 57*a*.

In the transport guide member 57, the holding portions 57*c* of the roller movement regulation portion 57*a* are attached to the side of the free ends of the shaft portions 51*a* and 52*a* in the pickup roller 51 and the paper feed roller 52. Here, by the utilization of the elastic deformation of the holding portion 57*c*, the insertion portions 57*e* are extended in the sheet transport direction (x direction in FIGS. 7 and 8) against the elastic force of the holding portion 57*c*, and thus the shaft portions 51*a* and 52*a* are passed through the shaft reception portions 57*d*. In order to easily extend the insertion portion 57*e* and reduce the damage of the holding portion 57*c*, a groove portion 57*f* is provided in a portion of the holding portion 57*c* on the side opposite to the insertion portion 57*e* through the shaft reception portion 57*d*.

In this way, the holding portions 57*c* hold the side of the free ends of the shaft portions 51*a* and 52*a* by a so-called snap-fit method. The fitting of the shaft reception portion 57*d* and the shaft portions 51*a* and 52*a* is realized with a slight gas in the radial direction and the direction of the shaft line.

The sheet guide portion 57*b* is coupled to the roller movement regulation portion 57*a*, and is extended along the direction (y direction in FIGS. 7 and 8) intersecting the sheet transport direction toward the pickup holder 55 (see FIG. 9). As shown in FIGS. 6 and 9, the sheet guide portion 57*b* is arranged between the pickup roller 51 and the paper feed roller 52 in the sheet transport direction, and is extended to a position where its tip end is close to the pickup holder 55. At the tip end of the sheet guide portion 57*b* on the side of the pickup holder 55, an engagement portion 57*g* for engaging with the pickup holder 55 is provided.

On the other hand, as shown in FIGS. 5 and 9, the pickup holder 55 has a protrusion portion 55*a* in a position corresponding to the engagement portion 57*g* of the sheet guide portion 57*b*. The protrusion portion 55*a* is extended between the pickup roller 51 and the paper feed roller 52 along the direction intersecting the sheet transport direction toward the sheet guide portion 57*b* of the transport guide member 57. At the tip end of the protrusion portion 55*a* on the side of the sheet guide portion 57*b*, a bent portion 55*b* which is bent upward and substantially perpendicularly is provided.

The engagement portion 57*g* of the sheet guide portion 57*b* has a space whose upper surface is open to the outside and which is formed substantially in the shape of a rectangular parallelepiped. The engagement portion 57*g* has a rectangular opening portion 57*h* which has such a size that the engagement portion 57*g* can receive the tip end of the protrusion portion 55*a* including the bent portion 55*b* of the pickup holder 55. The opening portion 57*h* is provided in the lower portion of the engagement portion 57*g* so as to face the pickup holder 55 and to face downward.

In the first stage of the attachment of the transport guide member 57 to the pickup holder 55, as shown in FIG. 10, the tip end portion of the protrusion portion 55*a* in the pickup holder 55 is inserted into the opening portion 57*h* of the engagement portion 57*g* in the transport guide member 57. Here, as shown in FIG. 10, the side of the roller movement regulation portion 57*a* is lowered with respect to the direction (the left/right lateral direction of FIG. 10) intersecting the sheet transport direction of the transport guide member 57, and thus the workability is enhanced.

Then, in the second stage of the attachment of the transport guide member 57 to the pickup holder 55, as shown in FIG. 11, the portion of the protrusion portion 55*a* including the bent portion 55*b* is inserted into the internal space of the engagement portion 57*g*. Then, the holding portions 57*c* of the roller movement regulation portion 57*a* in the transport guide member 57 reach the portions of the free ends of the shaft portions 51*a* and 52*a* in the pickup roller 51 and the paper feed roller 52. Here, when as shown in FIG. 11, the side of the roller movement regulation portion 57*a* is lowered with respect to the direction (the left/right lateral direction of FIG. 11) intersecting the sheet transport direction of the transport guide member 57, the holding portions 57*c* of the roller movement regulation portion 57*a* are located on the lower side of the free ends of the shaft portions 51*a* and 52*a*.

Then, in the final stage of the attachment of the transport guide member 57 to the pickup holder 55, as shown in FIG. 12, the portion of the roller movement regulation portion 57*a* in the transport guide member 57 is raised, and the holding portions 57*c* hold the side of the free ends of the shaft portions 51*a* and 52*a* by the so-called snap-fit method. In this way, the engagement portion 57*g* receives the tip end portion of the protrusion portion 55*a* in the pickup holder 55 through the opening portion 57*h* to engage with the pickup holder 55.

Within the engagement portion 57*g*, as shown in FIGS. 8 and 13, a first displacement regulation portion 57*j* and a second displacement regulation portion 57*k* for regulating the displacement of the transport guide member 57 are provided.

The first displacement regulation portion 57*j* is formed as the inner bottom surface of the space which is included in the engagement portion 57*g* and which is formed substantially in the shape of a rectangular parallelepiped. When the tip end portion of the protrusion portion 55*a* in the pickup holder 55 is inserted into the engagement portion 57*g* (see FIG. 13), and thus the transport guide member 57 is displaced upward by contact with the sheet, the first displacement regulation portion 57*j* makes contact with the lower surface of the protrusion portion 55*a* to regulate the upward displacement of the transport guide member 57.

The second displacement regulation portion 57*k* is formed as the inner surface, on the upstream side in the sheet transport direction, of the space which is included in the engagement portion 57*g* and which is formed substantially in the shape of a rectangular parallelepiped. When the tip end portion of the protrusion portion 55*a* in the pickup holder 55 is inserted into the engagement portion 57*g* (see FIG. 13), and thus the transport guide member 57 is displaced toward the downstream side in the sheet transport direction by contact with the sheet, the second displacement regulation portion 57*k* makes contact with the side surface of the protrusion portion 55*a* on the upstream side in the sheet transport direction to regulate the displacement of the transport guide member 57 along the sheet transport direction.

When the transport guide member 57 is not in contact with the sheet, the portion of the engagement portion 57*g* in the transport guide member 57 is moved downward by the action of gravity, and a wall portion on the upper side of the opening portion 57*h* of the engagement portion 57*g* is brought into contact with and is caught on the upper surface of the protrusion portion 55*a* of the pickup holder 55.

As shown in FIG. 13, the sheet guide portion 57*b* includes a flat surface portion 57*m* and an inclination portion 57*n* in a portion opposite the uppermost sheet of the sheets stacked in the paper feed cassette 42. The flat surface portion 57*m* and the inclination portion 57*n* are formed with a flat surface continuous in the sheet transport direction, and the flat surface portion 57*m* is arranged on the downstream side in the sheet transport direction and the inclination portion 57*n* is arranged on the upstream side in the sheet transport direction.

The flat surface portion 57*m* of the sheet guide portion 57*b* is substantially parallel to a tangent L which is common to the circumferential surfaces of the pickup roller 51 and the paper feed roller 52, that is, the upper surface of the sheet which is transported by the supply portion 50, and is extended in the sheet transport direction and a direction intersecting the sheet transport direction. The flat surface portion 57*m* is only a predetermined distance H away from the tangent L to an inner side in the radial direction of the rollers, that is, toward the upper side. The predetermined distance H is preferably set to, for example, a distance of 0.5 to 1.0 mm and is more preferably set to a distance of 0.5 mm.

As the upstream portion in the sheet transport direction is moved to the upstream side, the inclination portion 57*n* of the sheet guide portion 57*b* is moved upward, that is, as the upstream portion in the sheet transport direction is moved to the upstream side, the inclination portion 57*n* is moved away from the tangent L, is inclined so as to be moved upward and is extended in a direction intersecting the sheet transport direction. The inclination portion 57*n* is inclined at a predetermined angle θ with respect to the tangent L. The predetermined angle θ is preferably set to, for example, an angle of 20 to 45° and is more preferably set to an angle of 30°.

As in the embodiment described above, the paper feed device 40 of the image forming apparatus 1 includes: the pickup roller 51 which makes contact with, from above, an uppermost sheet of sheets stacked in the paper feed cassette 42 so as to feed out the sheet; the paper feed roller 52 which receives the sheet fed out by the pickup roller 51 and which further feeds the sheet to the downstream side in the transport direction; and the pickup holder 55 which supports the pickup roller 51. In the paper feed device 40, the pickup roller 51 and the paper feed roller 52 are cantilever-supported at one ends of the shaft portions 51*a* and 52*a* which penetrate the centers of the shaft lines, and on the side of the free ends of the shaft portions 51*a* and 52*a* of the pickup roller 51 and the paper feed roller 52, the sheet guide portion 57*b* is provided that includes: the roller movement regulation portion 57*a* which holds the shaft portions 51*a* and 52*a* and which regulates the movements of the rollers in the direction of the shaft lines; and the sheet guide portion 57*b* which guides the transport of the sheet between the pickup roller 51 and the paper feed roller 52.

In this configuration, in the transport guide member 57, the roller movement regulation portion 57*a* can hold the side of the free ends of the shaft portions 51*a* and 52*a* in the pickup roller 51 and the paper feed roller 52 and regulate the movements of the rollers in the direction of the shaft lines. The transport guide member 57 is a single member without using another member such as a retaining ring and can easily be attached to the apparatus. Moreover, in the transport guide member 57, with the sheet guide portion 57*b*, it is possible to guide the transport of the sheet between the pickup roller 51 and the paper feed roller 52. Hence, it is possible to provide the paper feed device 40 which can transport, with a simpler configuration, the sheet between the pickup roller 51 and the paper feed roller 52 in a suitable manner so as to enhance sheet transport performance.

The transport guide member 57 makes a distance between the shaft lines of the pickup roller 51 and the paper feed roller 52 on the side of the free ends of the shaft portions 51*a* and 52*a* of the pickup roller 51 and the paper feed roller 52 equal to a distance between the shaft lines of the pickup roller 51 and the paper feed roller 52 on the side of the support ends and holds the shaft portions 51*a* and 52*a*.

In this configuration, the shaft lines of the pickup roller 51 and the paper feed roller 52 can be parallel to each other. In this way, it is possible to reduce the oblique feeding of the sheet and the like, and thus it is possible to enhance the sheet transport performance.

The transport guide member 57 includes, on the side of the support ends of the shaft portions 51*a* and 52*a* of the pickup roller 51 and the paper feed roller 52, the engagement portion 57*g* for engaging with the pickup holder 55.

In this configuration, it is possible to easily maintain the position and the posture of the transport guide member 57. In this way, it is possible to realize the regulation of the movements of the rollers and the guide of the transport in a suitable manner.

The pickup holder 55 includes, in the position corresponding to the engagement portion 57*g* of the transport guide member 57, the protrusion portion 55*a* which has a bent portion 55*b* whose tip end is bent upward. The transport guide member 57 includes, in the engagement portion 57*g*, the opening portion 57*h* which receives the tip end of the protrusion portion 55*a* including the bent portion 55*b* of the pickup holder 55.

In this configuration, in the engagement portion 57*g*, it is possible to enhance the action for maintaining the predetermined position and the posture of the transport guide member 57. In this way, it is possible to enhance the roller movement regulation performance and the sheet transport guide performance.

The transport guide member 57 includes, in the engagement portion 57*g*, the first displacement regulation portion 57*j* which makes contact with the protrusion portion 55 to regulate the upward displacement of the transport guide member 57.

In this configuration, when the transport guide member 57 is pushed up by the sheet, it is possible to regulate the displacement of the transport guide member 57 with the first displacement regulation portion 57*j*. In this way, it is possible to enhance the sheet transport performance.

The transport guide member 57 includes, in the engagement portion 57*g*, the second displacement regulation portion 57*k* which makes contact with the protrusion portion 55 to regulate the displacement of the transport guide member 57 along the transport direction of the sheet.

In this configuration, when the transport guide member 57 is pushed by the sheet in the transport direction, it is possible to regulate the displacement of the transport guide member 57 with the second displacement regulation portion 57*k*. In this way, it is possible to enhance the sheet transport performance.

In the transport guide member 57, the sheet guide portion 57*b* includes a flat surface portion 57 which is away from the tangent L that is common to the circumferential surfaces of the pickup roller 51 and the paper feed roller 52 to the inner side in the radial direction of the rollers.

The transport guide member 57 includes the inclination portion 57*n* which is inclined so as to be moved upward as the upstream portion of the sheet guide portion 57*b* in the sheet transport direction is moved to the upstream side in the sheet transport direction.

In these configurations, it is possible to insert the sheet fed out by the pickup roller 51 to the downstream side in the sheet transport direction into the nip portion formed by bringing the paper feed roller 52 into contact with the separation roller 53 in a suitable manner. In this way, it is possible to more enhance the sheet transport performance.

Furthermore, in the embodiment, the paper feed device 40 configured as described above is provided in the image forming apparatus 1.

In this configuration, with the image forming apparatus 1, it is possible to transport, with a simpler configuration, the sheet between the pickup roller 51 and the paper feed roller 52 in a suitable manner so as to enhance the sheet transport performance.

Although the embodiment of the present invention is described above, the scope of the present invention is not limited to such an embodiment, and various modifications are possible without departing from the spirit of the invention.

For example, although in the embodiment described above, the image forming apparatus 1 is the image forming apparatus for color printing which uses the intermediate transfer belt 11 to transfer the toner image to the sheet P, there is no limitation to such a model, and the image forming apparatus 1 may be an image forming apparatus which does not use an intermediate transfer belt or an image forming apparatus for monochrome printing.

What is claimed is:

1. A paper feed device comprising:

a pickup roller which makes contact with, from above, an uppermost sheet of sheets stacked in a sheet storage portion so as to feed out the sheet;

a paper feed roller which receives the sheet fed out by the pickup roller and which further feeds the sheet to a downstream side in a transport direction; and a pickup holder which supports the pickup roller, wherein the pickup roller and the paper feed roller are cantilever-supported at one ends of shaft portions which penetrate centers of shaft lines, and on a side of free ends of the shaft portions of the pickup roller and the paper feed roller, a transport guide member is provided that includes: a roller movement regulation portion which holds the shaft portions and which regulates movements of the rollers in a direction of the shaft lines; and a sheet guide portion which guides the transport of the sheet between the pickup roller and the paper feed roller.

2. The paper feed device according to claim 1, wherein the transport guide member makes a distance between the shaft lines of the pickup roller and the paper feed roller on the side of the free ends of the shaft portions of the pickup roller and the paper feed roller equal to a distance between the shaft lines on a side of support ends and holds the shaft portions.

3. The paper feed device according to claim 1, wherein the transport guide member includes, on the side of support ends of the shaft portions of the pickup roller and the paper feed roller, an engagement portion for engaging with the pickup holder.

4. The paper feed device according to claim 3, wherein the pickup holder includes, in a position corresponding to the engagement portion, a protrusion portion which has a bent portion whose tip end is bent upward, and the transport guide member includes an opening portion which receives a tip end of the protrusion portion including the bent portion of the pickup holder.

5. The paper feed device according to claim 4, wherein the transport guide member includes, in the engagement portion, a first displacement regulation portion which makes contact with the protrusion portion to regulate an upward displacement of the transport guide member.

6. The paper feed device according to claim 4, wherein the transport guide member includes, in the engagement portion, a second displacement regulation portion which makes contact with the protrusion portion to regulate a displacement of the transport guide member along the transport direction of the sheet.

7. The paper feed device according to claim 1, wherein in the transport guide member, the sheet guide portion includes a flat surface portion which is away from a tangent that is common to circumferential surfaces of the pickup roller and the paper feed roller to an inner side in a radial direction of the rollers.

8. The paper feed device according to claim 1, wherein the transport guide member includes an inclination portion which is inclined so as to be moved upward as an upstream portion of the sheet guide portion in a sheet transport direction is moved to an upstream side in the sheet transport direction.

9. An image forming apparatus comprising:

the paper feed device according to claim 1.

* * * * *